United States Patent [19]

Brunnert

[11] Patent Number: 5,015,048

[45] Date of Patent: May 14, 1991

[54] CLOSING DEVICE FOR DRAWERS

[75] Inventor: Eberhard Brunnert, Elchingen, Fed. Rep. of Germany

[73] Assignee: Julius Blum Gesellschaft m.b.H., Hochst, Austria

[21] Appl. No.: 450,995

[22] Filed: Dec. 15, 1989

[30] Foreign Application Priority Data

Dec. 23, 1988 [AT] Austria ..... 3144/88

[51] Int. Cl.[5] ..... A47B 88/00; A47B 95/00

[52] U.S. Cl. ..... 312/319; 312/341.1; 16/79

[58] Field of Search ..... 16/71, 78, 79, 80; 312/319, 341.1

[56] References Cited

U.S. PATENT DOCUMENTS 2,626,420 1/1953 Lambert et al. ..... 16/79

3,699,608 10/1972 Schwarz ..... 16/79

*Primary Examiner*—Richard K. Seidel

*Assistant Examiner*—Carmine Cuda

*Attorney, Agent, or Firm*—Wenderoth, Lind & Ponack

[57] ABSTRACT

A closing device is provided for a drawer having a pull-out rail fastened to the drawer and a supporting rail fastened to the body of an article of furniture. An energy storing member is arranged between the drawer and the furniture body, preferably between the pull-out rail and the supporting rail. Such energy storing member stores part of kinematic energy imported thereto during opening of the drawer and releases such energy to the drawer during an end portion of movement of the drawer during closing thereof. The energy storing member includes a holding member which is pivotally mounted at a body side wall and includes a zone of contact having the shape of a circular arc for engagement with a tension pinion that is stationarily mounted with respect to the body side wall. The tension pinion has a frictional connection with the pull-out rail.

32 Claims, 4 Drawing Sheets

CLOSING DEVICE FOR DRAWERS

FIELD AND BACKGROUND OF THE INVENTION

The invention relates to a closing device for a drawer having on each side thereof a pull-out rail fastened to the drawer and a supporting rail fastened to the body of an article of furniture, with load transmitting rollers or the like being mounted at or between the rails. Energy storing means includes a spring and is arranged between the drawer and the furniture body, preferably between at least one pull-out rail and at least one supporting rail. Such energy storing means stores part of kinematic energy imported thereto and occurring during opening of the drawer and releases such energy to the drawer at least during an end portion of movement of the drawer during closing thereof. Such energy storing means further includes a holding member pivotally mounted at a body side wall.

A modern drawer conventionally is provided with a pull-out guide assembly which comprises, on each side of the drawer, a supporting rail on the side of the body and a pull-out rail in the side of the drawer, and which should make the displacement motion of the drawer as easy as possible. Rollers, balls or slides may be provided for transmission of the load between the pull-out rails on the sides of the drawer and the supporting rails on the sides of the body, depending on the requirements with respect to smooth running and loading capacity of the drawer.

It has been found that a drawer that is supposed to be closed in some cases will not be fully pushed into a rear end position, i.e. into the furniture body, and therefore may project with its front plate from the furniture body. As a result, a person may bump against the drawer which might cause injury to the person or damage to the drawer.

Projection of the drawer front plate from the front of the furniture body may occur when the drawer has been pushed in without care or has not fully been pushed into the furniture body. Further, when the drawer has been pushed into the furniture body with too much energy, the drawer may again roll forwardly after a stop has been abutted the end of a supporting rail.

A closing device for a drawer is known from British Patent Specification 1,117,071, wherein a pivot member is movable between two end positions. The pivot member is acted upon by a coil spring and is urged thereby into the respective end positions when a dead center position of the pivot member has been passed. The pivot member is fastened to a furniture side wall. One side wall of the drawer has a driving pin which during an end portion of the displacement path of the drawer is engaged in a notch of the pivot member. The driving pin then pushes the pivot member beyond a dead center position, whereupon the pivot member pulls the driving pin and thus the drawer towards the rear.

SUMMARY OF THE INVENTION

It is the object of the invention to provide a closing device with which a drawer may be pulled into a furniture body over a longer path of movement of the drawer, and wherein the pull-in motion of the drawer is as uniform as possible and free of jerky motion.

Accordingly the invention this object is achieved by providing that a holding member is pivotally mounted at the body side wall with a zone of contact having the shape of a circular arc for engagement with a tension pinion that is stationarily mounted with respect to a body side wall and that forms a fictional or rack-pinion connection with a pull-out rail or with a zone of contact of the drawer that is aligned parallel to the pull-out rail.

Obviously a reverse arrangement also could be possible but has not proved advantageous in practical experience. That is, the holding member and the tension pinion could be mounted at the drawer side wall and the tension pinion could form a frictional connection with the supporting rail on the side of the furniture body. It is advantageously provided that the tension pinion is mounted at a supporting rail.

A further embodiment of the invention provides that a portion of the surface area of the tension pinion is cylindrical, that such cylindrical portion is provided with a friction-increasing covering, and that such covering rests against a running flange of the pull-out rail.

Advantageously, the holding member is sector-shaped when the drawer is viewed from the side, and stop members are provided forwardly and rearwardly of the holding member to limit the angle of pivoting of the holding member.

To guarantee the pivoting motion of the holding member, and thus the tensioning of the spring, in a direction counter to the pull-out direction of the drawer when the drawer is being extracted, it is advantageously provided that the holding member is provided with an arc-shaped toothed rack which meshes with the tension pinion in the zone of contact therebetween.

The invention further provides that during the push-in motion of the drawer, the holding member is turned by the spring in a direction counter to the direction of movement of the drawer.

BRIEF DESCRIPTION OF THE DRAWING

In the following embodiments of the invention will be described in more detail with reference to the accompanying drawings in which.

DETAILED DESCRIPTION OF THE INVENTION

Figure 1:
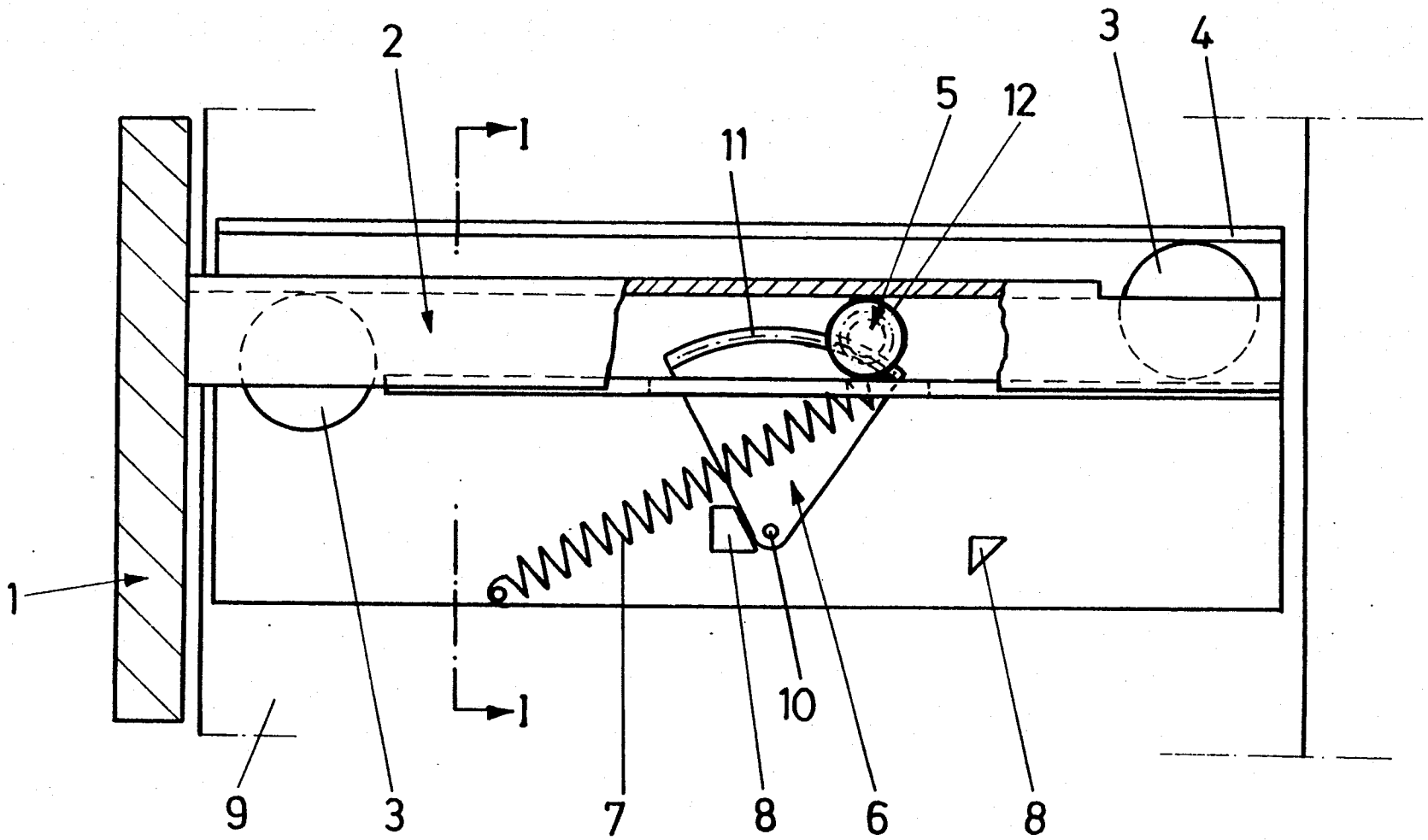
FIGS. 1 to 3 are side views of different positions of a drawer with a preferred embodiment of a closing device according to the invention.

In the drawings, a drawer is designated by reference number 1 and a body side wall by 9. A supporting rail 4 is fastened to the body side wall 9 and has a partial U-shaped profile. A pull-out rail 2 is fastened to a side wall of the drawer. Rollers 3 are mounted at the front end of the supporting rail 4 and at the rear end of the pull-out rail 2.

The drawings show only one side of the drawer and a pull-out guide assembly therefor, and the structure at the other side obviously is analogous. A closing device according to the invention can, depending on the particular requirements, be provided only on one side or both sides of the drawer 1.

The closing device according to the invention comprises a sector-shaped holding member 6, a tension pinion 5 and a spring 7. The holding member 6 is pivotally mounted by an axle 10 to a vertical flange of the supporting rail 4. Opposite the axle 10, the holding member 6 is provided with an arc-shaped toothed rack 11 that meshes with pinion member 5 that also is mounted at the vertical flange of the supporting rail 4.

The holding member 6 is acted upon by spring 7, which is a coil spring in the illustrated embodiment. Particularly, when the drawer is in the closed position and during the push-in movement of the drawer, the holding member 6 is pulled by the spring 7 in a direction towards a front plate of drawer 1.

Stop members 8 are arranged forwardly and rearwardly of holding member 6. Stop members 8 limit the extent or angle of pivoting of the holding member 6.

The pinion member has a portion with teeth 5' which mesh with the toothed rack 11 of the holding member 6. Adjacent the portion with teeth 5', pinion member 5 has a portion with a cylindrical surface provided with an elastic covering 12 which increases the friction between the tension pinion member 5 and a confronting surface of a running flange of the pull-out rail 2.

Figure 2:
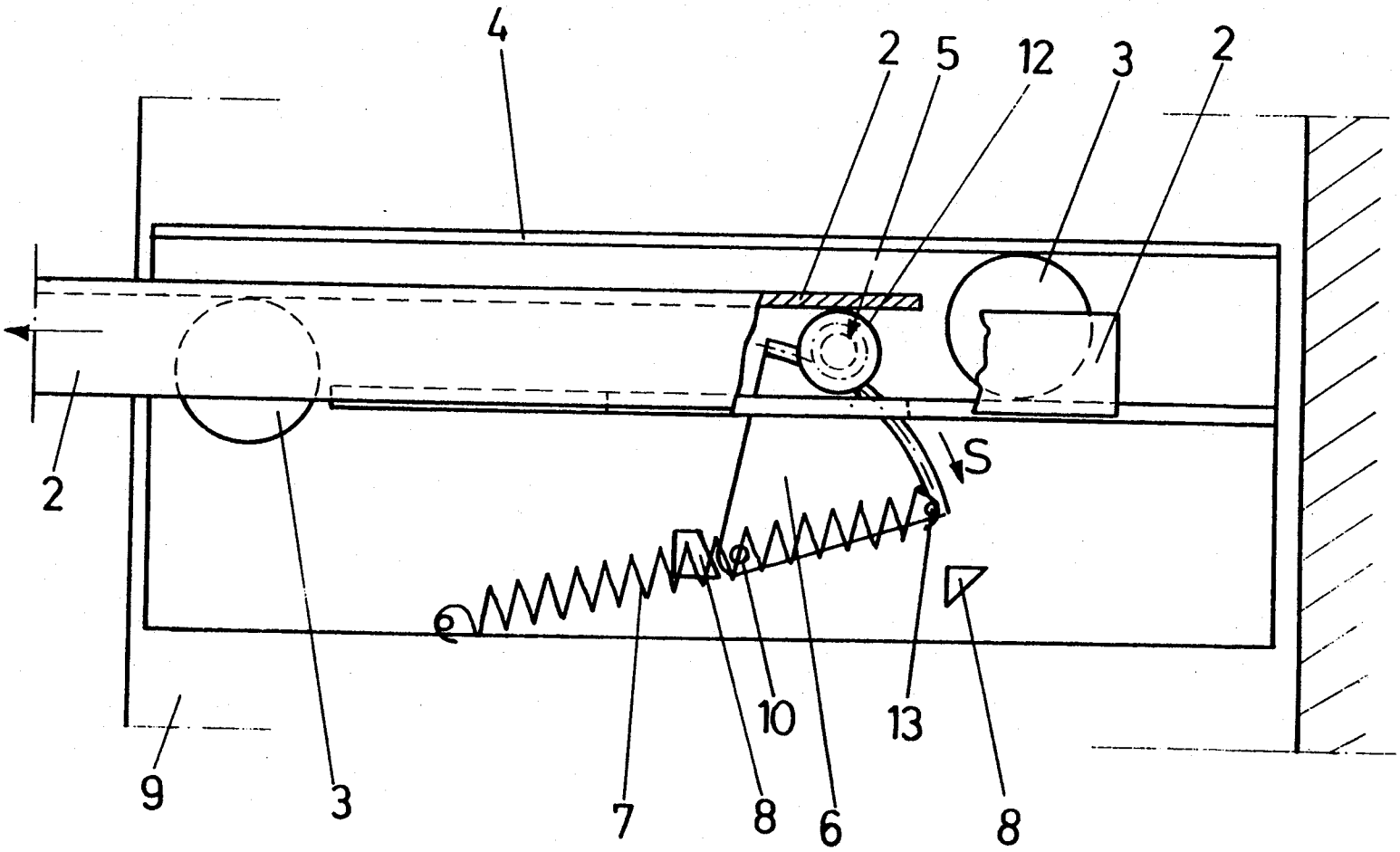
Figure 3:
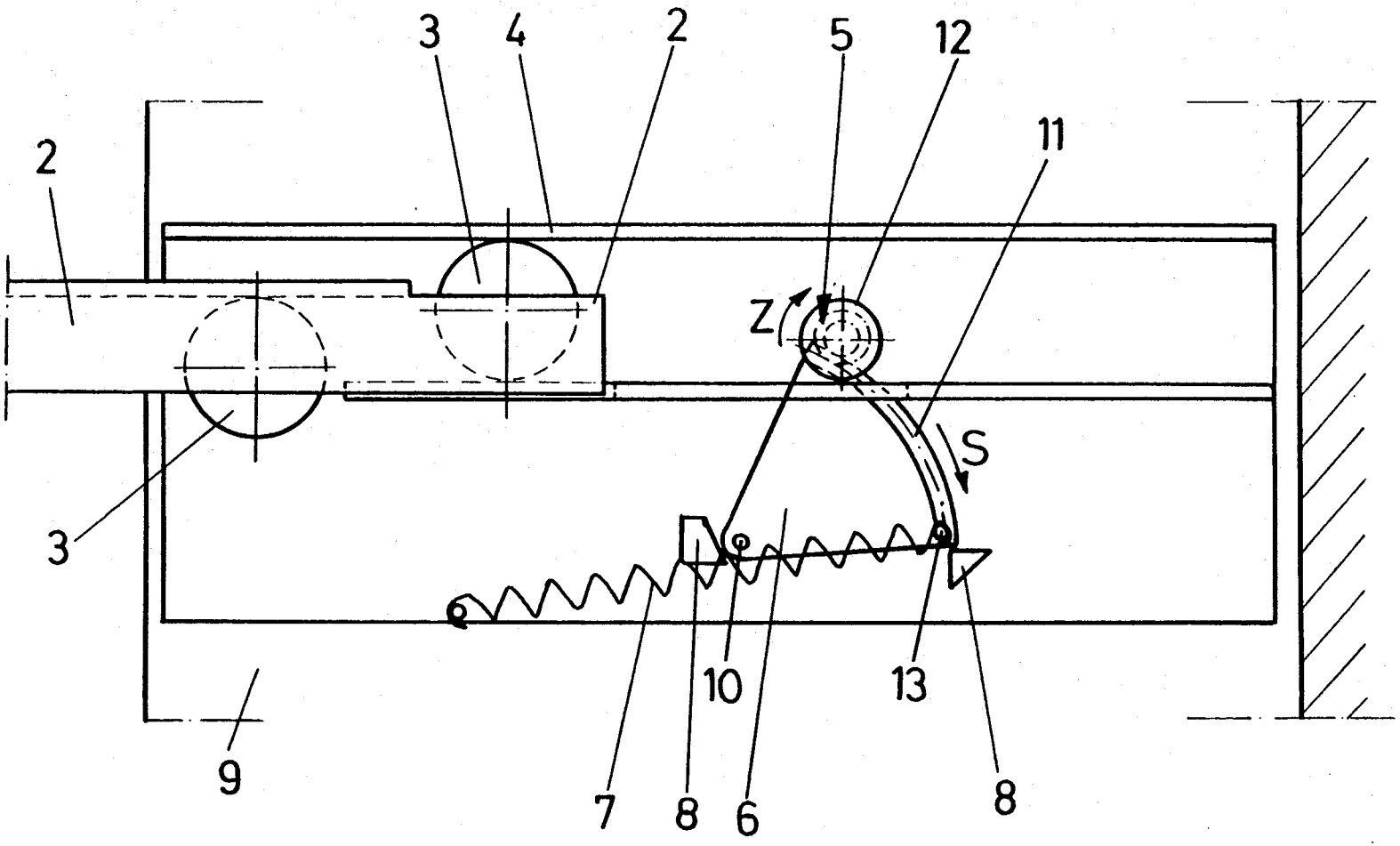
Figure 4:
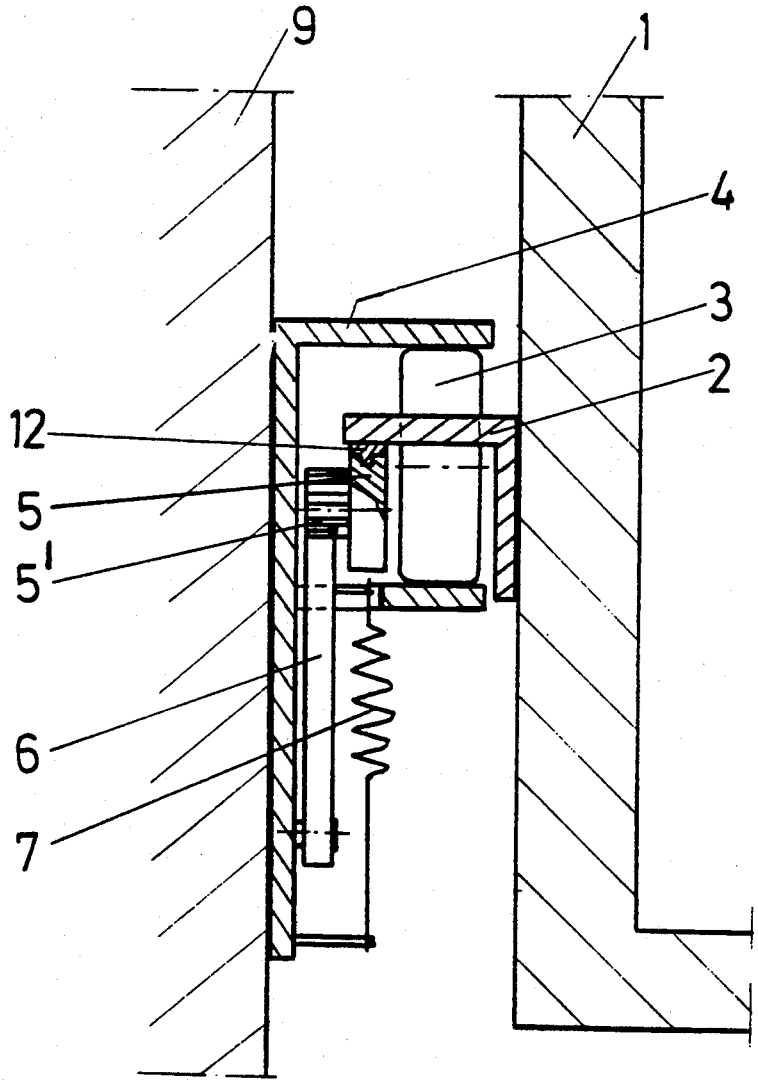
FIG. 4 is a sectional view along line 4—4 of FIG. 1.

When the drawer 1 is in the closed position shown in FIG. 1, the holding member 6 abuts with the forward stop member 8, and the tension pinion member 5 is located near the rear end of the toothed rack 11. When the drawer 1 is being pulled out, the tension pinion member 5 is rotated by the friction between covering 12 and the pull-out rail 2, and thus teeth 5' pivot the holding member 6 in the direction of arrow S, as shown in FIG. 2. The spring 7 is thus tensioned. An anchoring point 13 of the spring 7 with the holding member 6 is moved slightly beyond a dead center position, and the holding member 6 is caused to abut the rear stop member, as shown in FIG. 3. Pinion member 5 then is located at the front end of toothed rack 11, and the pull-out rail 2 then may move freely beyond the closing device.

When the drawer 1 and thus the pull-out rail 2 are moved into the body of the piece of furniture, when the horizontal flange of the pull-out rail 2 reaches the tension pinion member 5, it contacts covering 12 and rotates pinion 5 is a direction Z. Teeth 5' then move member 6 in a direction opposite to direction S and member 6 thus is moved dead center position. The spring 7 then pulls the holding member 6 forwardly, whereby the tension pinion member 5 is turned further in the direction of arrow Z. Due to the frictional contact between the covering 12 and the horizontal flange of the pull-out rail 2, the pull-out rail 2 and thus the drawer are pulled rearwardly into the furniture body.

What is claimed is:

1. A closing device, for use in an article of furniture including a furniture body and a drawer slidable in opposite directions into and out of the furniture body, for moving the drawer to a fully inserted position within the furniture body, said closing device comprising:

a holding member to be pivotally mounted with respect to one of the drawer or the furniture body, said holding member having a contact zone in the shape of a circular arc;

a tension pinion member to be rotatably mounted at a fixed position on the same one of the drawer or the furniture body on which said holding member is to be pivotably mounted;

said pinion member having first means for engagement with a portion of the other of the furniture body or the drawer that extends parallel to the directions of movement of the drawer into and out of the furniture body, such that as the drawer is moved into and out of the furniture body engagement between such portion and said first means causes rotation of said pinion member;

said pinion member having second means engaging said contact zone of said holding member such that rotation of said pinion member causes pivotal movement of said holding member; and spring means acting on said holding member such that:

as the drawer is moved in a direction outwardly of the furniture body, said first means causes rotation of said pinion member in a first direction of rotation and said second means thereby causes pivoting of said holding member against the force of said spring means in a first direction of pivoting, thus storing energy in said spring means; and upon release of the force of movement of the drawer in the direction outwardly of the furniture body, the stored energy in said spring means pivots said holding member in a second direction of pivoting opposite to said first direction of pivoting, said second means thereby causes rotation of said pinion member in a second direction of rotation opposite to said first direction of rotation, and said first means thereby is operable to cause the drawer to slide in a direction into the furniture body to the fully inserted position.

2. A device as claimed in claim 1, wherein said holding member and said pinion member are to be mounted on the furniture body, and said spring means is to act on the furniture body.

3. A device as claimed in claim 1, further comprising a supporting rail to be mounted on the furniture body, and wherein said holding member and said pinion member are mounted on said supporting rail.

4. A device as claimed in claim 3, further comprising a pull-out rail to be mounted on the drawer and wherein said first means engages with a surface of said pull-out rail.

5. A device as claimed in claim 4, wherein said first means comprises a friction-enhanced covering on said pinion member and defining a surface contacting said surface of said pull-out rail.

6. A device as claimed in claim 5, wherein said surface of said covering is cylindrical.

7. A device as claimed in claim 5, wherein said pull-out rail has a configuration such that, when the drawer is in a fully outward position relative to the furniture body, said surface of said pull-out rail is out of contact with said surface of said covering.

8. A device as claimed in claim 1, wherein said holding member is pivoted about an axle located with respect to said spring means such that said axle acts as a dead center position with respect to the direction of pivoting of said holding member by said spring means.

9. A device as claimed in claim 8, wherein when the drawer is moved to a fully outward position relative to the furniture body, said spring means moves past said dead center position and urges said holding member to pivot about said axle in said first direction of pivoting, whereby the drawer is allowed to remain in the fully outward position.

10. A device as claimed in claim 1, wherein said first means comprises a friction-enhanced covering on said pinion member and defining a surface to contact the portion of the other of the furniture body or the drawer.

11. A device as claimed in claim 10, wherein said surface of said covering is cylindrical.

12. A device as claimed in claim 1, wherein said holding member has a sector-shaped configuration.

13. A device as claimed in claim 1, wherein said circular arc-shaped contact zone of said holding member is centered about a pivot axis of said holding member.

14. A device as claimed in claim 1, further comprising stop means for limiting the extent of pivotal movement of said holding member in both of said first and second directions of pivoting.

15. A device as claimed in claim 1, wherein said contact zone of said holding member comprises a toothed rack, and said second means of said pinion member comprises pinion teeth meshing with teeth of said rack.

16. A device as claimed in claim 1, wherein said second direction of pivoting of said holding member is opposite to the direction of movement of the drawer into the furniture body.

17. In an article of furniture including a furniture body, a drawer slidable in opposite directions into and out of said furniture body, and a closing device for moving said drawer to a fully inserted position within said furniture body, the improvement wherein said closing device comprises:

a holding member pivotally mounted with respect to one of said drawer or said furniture body, said holding member having a contact zone in the shape of a circular arc;

a tension pinion member rotatably mounted at a fixed position on the same one of said drawer or said furniture body on which said holding member is pivotably mounted;

said pinion member having first means for engagement with a portion of the other of said furniture body or said drawer that extends parallel to the directions of movement of said drawer into and out of said furniture body, such that as said drawer is moved into and out of said furniture body engagement between such portion and said first means causes rotation of said pinion member;

said pinion member having second means engaging said contact zone of said holding member such that rotation of said pinion member causes pivotal movement of said holding member; and spring means acting on said holding member such that:

as said drawer is moved in a direction outwardly of said furniture body, said first means causes rotation of said pinion member in a first direction of rotation and said second means thereby causes pivoting of said holding member against the force of said spring means in a first direction of pivoting, thus storing energy in said spring means; and upon release of the force of movement of said drawer in said direction outwardly of said furniture body, the stored energy in said spring means pivots said holding member in a second direction of pivoting opposite to said first direction of pivoting, said second means thereby causes rotation of said pinion member in a second direction of rotation opposite to said first direction of rotation, and said first means thereby is operable to cause said drawer to slide in a direction into said furniture body to the fully inserted position.

18. The improvement claimed in claim 17, wherein said holding member and said pinion member are mounted on said furniture body, and said spring means acts on said furniture body.

19. The improvement claimed in claim 17, further comprising a supporting rail mounted on said furniture body, and wherein said holding member and said pinion member are mounted on said supporting rail.

20. The improvement claimed in claim 19, further comprising a pull-out rail mounted on the drawer and wherein said first means engages with a surface of said pull-out rail.

21. The improvement claimed in claim 20, wherein said first means comprises a friction-enhanced covering on said pinion member and defining a surface contacting said surface of said pull-out rail.

22. The improvement claimed in claim 21, wherein said surface of said covering is cylindrical.

23. The improvement claimed in claim 21, wherein said pull-out rail has a configuration such that, when said drawer is in a fully outward position relative to said furniture body, said surface of said pull-out rail is out of contact with said surface of said covering.

24. The improvement claimed in claim 17, wherein said holding member is pivoted about an axle located with respect to said spring means such that said axle acts as a dead center position with respect to the direction of pivoting of said holding member by said spring means.

25. The improvement claimed in claim 24, wherein when said drawer is moved to a fully outward position relative to said furniture body, said spring means moves past said dead center position and urges said holding member to pivot about said axle in said first direction of pivoting, whereby said drawer is allowed to remain in said fully outward position.

26. The improvement claimed in claim 17, wherein said first means comprises a friction-enhanced covering on said pinion member and defining a surface to contact said portion of the other of said furniture body or said drawer.

27. The improvement claimed in claim 26, wherein said surface of said covering is cylindrical.

28. The improvement claimed in claim 17, wherein said holding member has a sector-shaped configuration.

29. The improvement claimed in claim 17, wherein said circular arc-shaped contact zone of said holding member is centered about a pivot axis of said holding member.

30. The improvement claimed in claim 17, further comprising stop means for limiting the extent of pivotal movement of said holding member in both of said first and second directions of pivoting.

31. The improvement claimed in claim 17, wherein said contact zone of said holding member comprises a toothed rack, and said second means of said pinion member comprises pinion teeth meshing with teeth of said rack.

32. The improvement claimed in claim 17, wherein said second direction of pivoting of said holding member is opposite to the direction of movement of said drawer into said furniture body.

* * * * *